US010550862B2

(12) United States Patent
Wechsel et al.

(10) Patent No.: US 10,550,862 B2
(45) Date of Patent: Feb. 4, 2020

(54) PRESSURE-CONTROLLED 2-WAY FLOW CONTROL VALVE FOR HYDRAULIC APPLICATIONS AND VALVE ASSEMBLY COMPRISING SUCH A 2-WAY FLOW CONTROL VALVE

(71) Applicant: HAWE HYDRAULIK SE, Munich (DE)

(72) Inventors: Thomas Wechsel, Munich (DE); Martin Heusser, Munich (DE)

(73) Assignee: HAWE HYDRAULIK SE, Munich (DE)

( * ) Notice: Subject to any disclaimer, the term of this patent is extended or adjusted under 35 U.S.C. 154(b) by 476 days.

(21) Appl. No.: 15/152,668

(22) Filed: May 12, 2016

(65) Prior Publication Data

US 2016/0333898 A1 Nov. 17, 2016

(30) Foreign Application Priority Data

May 12, 2015 (EP) ..... 15167276

(51) Int. Cl.
*F15B 13/02* (2006.01)
*F15B 13/042* (2006.01)
*F15B 13/04* (2006.01)

(52) U.S. Cl.
CPC ..... *F15B 13/042* (2013.01); *F15B 13/026* (2013.01); *F15B 13/0402* (2013.01); *F15B 2211/30535* (2013.01); *F15B 2211/50572* (2013.01); *F15B 2211/5753* (2013.01); (Continued)

(58) Field of Classification Search
CPC .... F15B 11/163; F15B 11/161; F15B 13/026; F15B 2211/465; F15B 2211/30535; F15B 2211/50572; F15B 2211/5753; F15B 2211/5756; F15B 13/042; F15B 13/0402; Y10T 137/87217; Y10T 137/87225; Y10T 137/86574; Y10T 137/86582; (Continued)

(56) References Cited

U.S. PATENT DOCUMENTS 3,866,419 A * 2/1975 Paul ..... B66F 9/22 60/427
3,979,907 A * 9/1976 Paul ..... B66F 9/22 137/101
6,516,614 B1 2/2003 Knoll

FOREIGN PATENT DOCUMENTS

DE 19855187 A1 5/2000
DE 102012220863 A1 5/2014
EP 2818732 A1 12/2014

OTHER PUBLICATIONS

Extended European Search Report dated Nov. 19, 2015, Application No. 15 167 276.3, 6 Pages.

* cited by examiner

*Primary Examiner* — Craig J Price
(74) *Attorney, Agent, or Firm* — Brooks Kushman P.C.

(57) ABSTRACT

The present disclosure provides, in a first aspect, a pressure-controlled 2-way flow control valve for hydraulic applications, wherein the 2-way flow control valve has applied thereto a first pressure signal in the closing direction of the 2-way flow control valve by means of a first output-side tapping and a second pressure signal in the opening direction by means of an LS pressure reporting duct. A pressure signal corrupting the first or second pressure signal is applied to the 2-way flow control valve in the closing or opening direction by means of a second tapping which is effective at least over part of the control stroke of the 2-way flow control valve.

20 Claims, 6 Drawing Sheets

(52) U.S. Cl.
CPC ..... *F15B 2211/5756* (2013.01); *Y10T 137/87217* (2015.04)

(58) Field of Classification Search
CPC ..... Y10T 137/8659; Y10T 137/86598; Y10T 137/86622; Y10T 137/8663
USPC .... 60/422, 327, 452, 459, 449, 399; 91/446, 91/447, 448, 532, 514; 251/28, 29; 137/596.17, 596.18, 625.2, 625.6, 625.61, 137/625.62, 625.65, 625.66
See application file for complete search history.

PRESSURE-CONTROLLED 2-WAY FLOW CONTROL VALVE FOR HYDRAULIC APPLICATIONS AND VALVE ASSEMBLY COMPRISING SUCH A 2-WAY FLOW CONTROL VALVE

CROSS-REFERENCE TO RELATED APPLICATIONS

This application claims foreign priority benefits under 35 U.S.C. § 119(a)-(d) to European patent application number EP 15 167 276.3, filed May 12, 2015, which is incorporated by reference in its entirety.

TECHNICAL FIELD

The present disclosure relates to pressure-controlled 2-way flow control valves for hydraulic applications and valve assemblies for hydraulic applications comprising such a 2-way flow control valve.

BACKGROUND

In sophisticated hydraulic circuits of e.g., cranes, concrete distributing booms and other load lifting and manipulating units, proportional directional spool valves are normally used for allowing a plurality of consumers to be operated simultaneously. In practical use, it is frequently necessary to control a plurality of consumers completely individually and at the same time, and this control should be effected such that it is independent of the load pressure to the highest possible degree.

From the HAWE product overview 2011, pages 98 to 101, a proportional directional spool valve, type PSL, with connection blocks and an ancillary block is known. With respect to FIG. 1*a*, a hydraulic circuit is schematically shown, in which two known proportional directional spool valves, type PSL, designated by reference symbols PS1, PS2 in the figure, with a suitable connection block for a constant delivery pump 1, are provided for the operation of two consumers V1, V2. A supply pressure P outputted by a constant delivery pump 1 is fed through a supply line 6 to a plurality of consumers V1, V2, e.g., hydraulic cylinders, via the respective proportional directional spool valves PS1, PS2 for driving the consumers V1, V2, which are shown in a highly schematized representation. The inflow upstream of the proportional directional spool valves PS1, PS2 is controlled by a respective pressure-controlled 2-way directional control valve 41, 42 disposed upstream of each proportional directional spool valve PS1, PS2 in the inflow direction. If, during operation, at least one of the consumers V1, V2 is to be operated, the proportional directional spool valve PS1, PS2 associated therewith is deflected upwards or downwards from the shut-off condition shown, depending on whether a connection A1, A2 or B1, B2 connected to the respective consumer V1, V2 is to be connected to the supply line 6. By means of the deflection stroke, a volumetric flow to the respective consumer V1, V2 is predetermined by the proportional directional spool valves PS1, PS2.

Via a suitable LS duct LS1, LS2 (shown by a broken line in FIG. 1), a load pressure dropping downstream of the respective proportional directional spool valve PS1, PS2 is signaled to the associated 2-way directional control valve 41, 42. In addition, it is guaranteed by means of shuttle valves 2 that the highest load pressure among the load pressures signaled by the LS ducts LS1, LS2 (corresponds to the load pressures dropping across the consumers V1, V2) is signaled to a circulation regulator 8 of the constant delivery pump system.

The load pressure signaled by the LS ducts LS1 and LS2 to the 2-way directional control valves 41 and 42 is—supporting the pre-load of the pre-load spring—applied to the 2-way directional control valve 41 and 42, respectively, such that it acts in the opening direction of the 2-way directional control valve 41 and 42. In addition, a pressure signal tapped off at the output side of the respective 2-way directional control valve 41, 42 is applied to each 2-way directional control valve 41, 42 in the closing direction (i.e., counteracting the pre-load) of the respective 2-way directional control valve 41, 42. Each of the 2-way directional control valves 41, 42 is pre-loaded in the opening direction by a pre-load spring so that the 2-way directional control valves 41, 42 are open in the idle state.

It follows that, in the condition of equilibrium, a specific pressure difference will occur between the tapped LS pressure and a pressure signal corresponding to the tapped output-side pressure of the 2-way directional control valve. Changes in the volumetric flow are thus controlled to a constant value in the case of springs having a small spring constant or a flat spring characteristic. Hence, each of the 2-way directional control valves 41, 42 controls a volumetric flow through the respective proportional directional spool valve PS1, PS2 to a constant value in a load-independent manner. In other words, if the volumetric flow occurring downstream of the proportional directional spool valve PS1 or PS2 decreases during operation of the consumer V1 or V2, also the pressure difference between the pressure dropping downstream of the 2-way directional control valve 41 or 42 (signaled as "$p_A$") and the load pressure dropping downstream of the proportional directional spool valve (signaled as "$p_{LS}$" to the 2-way flow control valve 41 or 42 via the LS duct LS1 or LS2) will decrease, so that a control piston (not shown) will shift in the 2-way directional control valve 41 or 42 along the opening direction. The consequence is that an equilibrium of forces is reestablished at the control piston in the 2-way directional control valve 41 or 42, although at a larger throttle cross-section in the 2-way directional control valve 41 or 42, so that the reduction of the volumetric flow and of the pressure difference ($p_A-p_{LS}$) is compensated for. The volumetric flow to the consumer and the pressure difference between the pressure provided by the constant delivery pump 1 and the pressure in the load circuit to the consumer are thus controlled to a constant value. If, however, the pressure difference ($p_A-p_{LS}$) at the proportional directional spool valve PS1 or PS2 increases, which corresponds to an increase in the volumetric flow, the 2-way flow control valve will be controlled in the closing direction until a new equilibrium of forces is established. In the 2-way directional control valve a control piston (not shown) shifts in the closing direction whereby a throttle cross-section in the 2-way directional control valve 41 or 42 is reduced. A reduction of the throttle cross-section, however, means that the volumetric flow and the pressure difference ($p_A-p_{LS}$) will decrease (counteracting the initial increase) until an equilibrium of forces is reestablished.

In FIG. 1*b* the resultant characteristic of the 2-way directional control valve 41, 42 is shown in a schematic representation, in which a volumetric flow Q (along the x-coordinate in arbitrary units) is plotted against a pressure difference Δp (corresponds to a pressure difference of pump pressure—$p_{LS}$) (along the y-coordinate in arbitrary units). After an initial triggering curve section AK, the characteristic shown in FIG. 1*b* exhibits a control curve section RK with a vertical profile, which stands for the independence of the volumetric flow from the pressure difference Δp when an equilibrium of forces is established, since, in the control curve section, the volumetric flow is controlled to a constant value Q0 independently of the pressure difference Δp.

It is an object of the present disclosure to provide a volumetric flow control, which deviates from the above described load-independent volumetric flow control and which, for improving the variability of hydraulic circuits, allows a load-dependent volumetric flow control depending on the specific case of use. For example, in order to accomplish a "good operational feeling" a load-dependent control of the volumetric flow may, in some cases of use, definitely be desirable so as to impart to the user a "feeling for the load".

It is e.g., an object of the present disclosure to provide a 2-way flow control valve and a valve assembly comprising such a 2-way flow control valve, which stabilize the volumetric flow control at the operating points, especially in the case of interaction with other hydraulic controllers, and/or allow a more precise volumetric flow control in the low differential pressure range.

SUMMARY

The following presents a simplified summary of the disclosure in order to provide a basic under-standing of some aspects of the disclosure. This summary is not an exhaustive overview of the disclosure. It is not intended to identify key or critical elements of the disclosure or to delineate the scope of the disclosure. Its sole purpose is to present some concepts in a simplified form as a prelude to the more detailed description that is discussed later.

According to a first aspect of the present disclosure, the above tasks and problems are solved by a pressure-controlled 2-way flow control valve for hydraulic applications. According to illustrative embodiments, the 2-way flow control valve may have applied thereto a first pressure signal in the closing direction of the 2-way flow control valve by means of a first output-side tapping and a second pressure signal in the opening direction by means of an LS pressure signaling duct. Herein, a pressure signal corrupting the first or second pressure signal may be applied to the 2-way flow control valve in the closing or opening direction by means of a second tapping which may be effective at least over a portion of the control stroke of the 2-way flow control valve.

Due to the corrupting pressure signal, a manipulation of a characteristic provided by the 2-way flow control valve may be accomplished so that, in the control curve section, the characteristic of the manipulated flow control valve may exhibit a profile deviating from the vertical profile (cf. FIG. 1*b*) and so that, in particular, the volumetric flow may be established in a pressure-dependent manner. The manipulation of the 2-way flow control valve may lead to a stabilization of the volumetric flow control in a few operating points, which may be advantageous when the 2-way flow control valve interacts with other hydraulic controllers.

According to another illustrative embodiment, the corrupting pressure signal may be applied only over a portion of the control stroke of the 2-way flow control valve. This may result in a sectionwise manipulation of the characteristic of the 2-way flow control valve, which may be effective at least in a specific section of the control stroke.

According to a more advantageous embodiment, the corrupting pressure signal may be applied via a first nozzle or a first orifice to the 2-way flow control valve in the closing or opening direction in the part of the control stroke tapping the corrupting pressure signal. By means of the first nozzle or the first orifice, an extent of manipulation may be easily defined.

According to another illustrative embodiment of the present disclosure, the 2-way flow control valve may further comprise a second nozzle or a second orifice connected in series with the first nozzle or the first orifice, the corrupting pressure signal being applied to the 2-way flow control valve via a control connection arranged between the nozzles or the orifices. By means of the resultant series connection comprising two orifices, two nozzles or one orifice and one nozzle, an advantageous adjustment of the manipulation pressure at the 2-way flow control valve may be accomplished.

According to another illustrative embodiment of the present disclosure, the second tapping may be arranged on the input side of the 2-way flow control valve. This may be a structurally simple mode of providing the pressure manipulation.

According to an illustrative embodiment, the corrupting pressure signal may be applied in the opening direction, so that, when the difference between the first pressure signal and the second pressure signal increases, an increasing volumetric flow may be established on the output side of the 2-way flow control valve. The resultant volumetric flow control may have a damping effect on pressure fluctuations occurring in the hydraulic system.

According to another illustrative embodiment, the corrupting pressure signal may be applied in the closing direction, so that, when the difference between the first pressure signal and the second pressure signal increases, a decreasing volumetric flow may be established on the output side of the 2-way flow control valve. A desired overcompensation can thus be achieved, if necessary. Instabilities at certain operating points in the hydraulic system, which may lead e.g., in the performance limiting range to a limitation of the pump performance, may be stabilized in this way.

According to another illustrative embodiment of the present disclosure, the second tapping may be arranged on the output side of the 2-way flow control valve and the corrupting pressure signal may be applied in the opening direction. This may allow optimizing energy insofar as a comparatively small pressure difference suffices for controlling a volumetric flow to a constant value, whereby the control quality may be improved and even small pressure differences may thus allow a more precise volumetric flow control. Furthermore, a volumetric flow with respect to a given pressure difference may be higher in comparison with a 2-way flow control valve having a conventional characteristic.

According to an illustrative embodiment, the control stroke may comprise a flow-through section and a shut-off section, in which no volumetric flow occurs on the output side of the 2-way flow control valve, the corrupting pressure signal being, in the flow-through section, applied to the 2-way flow control valve only over part of the control stroke. This may allow a manipulation that may only occur over a portion of the control stroke.

According to a further illustrative embodiment of the present disclosure, the 2-way flow control valve may be configured such that the corrupting pressure signal may be blocked only over a portion of the control stroke. Thus, it may be possible to perform an unmanipulated control in a control range. Here, a pressure-independent volumetric flow control may be maintained over a portion of the control stroke.

According to a second aspect of the present disclosure, a valve assembly for hydraulic applications is provided. In accordance with illustrative embodiments of the disclosure, the valve assembly may comprise a proportional directional spool valve for controlling a hydraulic consumer and a 2-way flow control valve according to the above-described first aspect of the disclosure, wherein the 2-way flow control valve may be connected to the proportional directional spool valve on the output side.

According to a third aspect of the present disclosure, a valve assembly for hydraulic applications is provided. In accordance with illustrative embodiments of the disclosure, the valve assembly may comprise a proportional directional spool valve for controlling a hydraulic consumer and a 2-way flow control valve according to the above-described first aspect of the disclosure, the 2-way flow control valve being connected to the proportional directional spool valve on the input side.

According to an illustrative embodiment of the second or third aspect, the proportional directional spool valve may be integrated in a valve block, together with the 2-way flow control valve. This may provide an advantageous compact structural design for valve assemblies according to the second or third aspect.

BRIEF DESCRIPTION OF THE DRAWINGS

Other advantageous embodiments of the present disclosure will be described hereinafter with reference to the attached drawings.

Figure 1A:
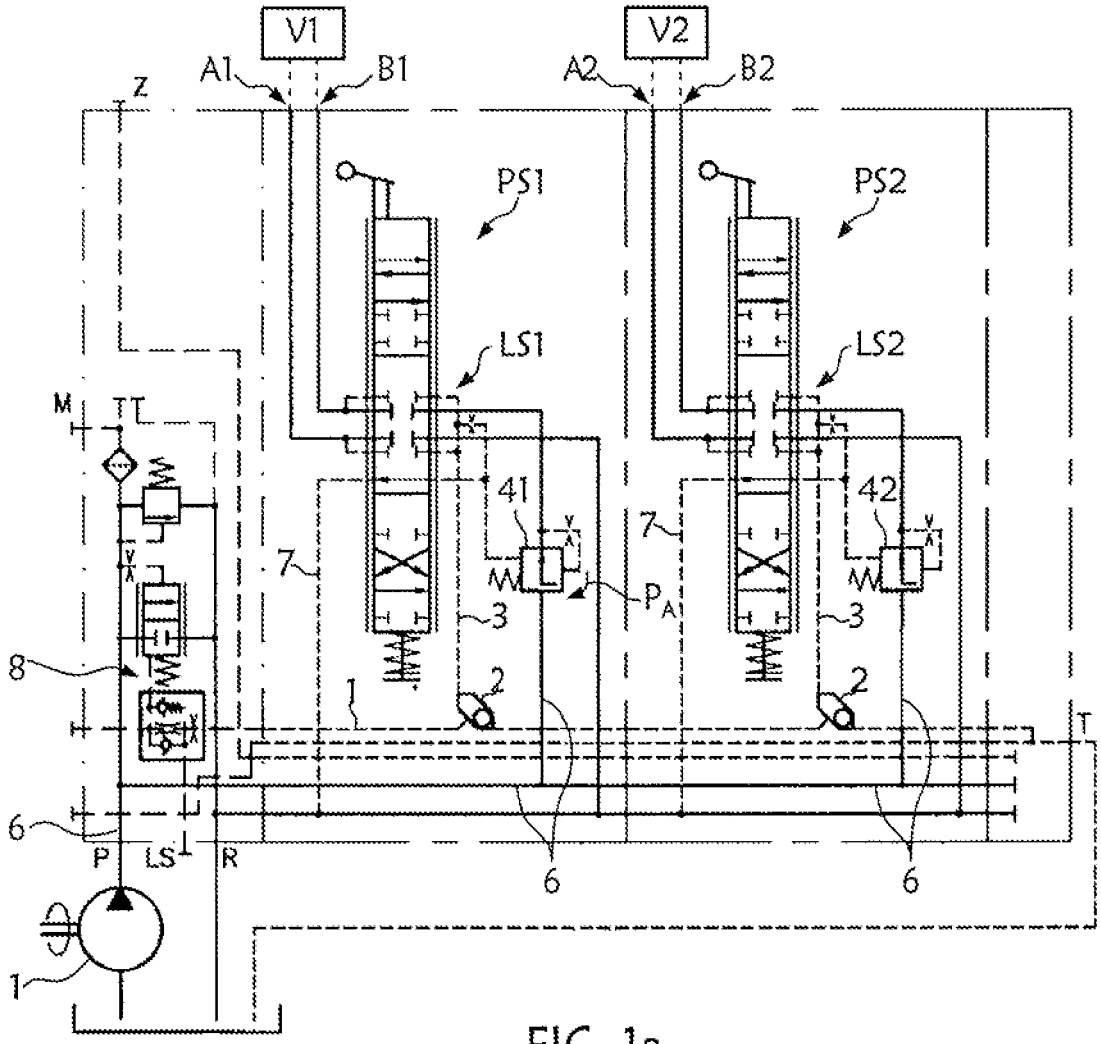
FIG. 1a Prior Art
FIG. 1*a* shows a schematic representation of a known valve assembly comprising 2-way directional control valves.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

DETAILED DESCRIPTION

Various illustrative embodiments of the disclosure are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present disclosure will now be described with reference to the attached figures. Various structures, systems and devices are schematically depicted in the drawings for purposes of explanation only and so as to not obscure the present disclosure with details which are well known to those skilled in the art. Nevertheless, the attached drawings are included to describe and explain illustrative examples of the present disclosure. The person skilled in the art will appreciate that the figures are not necessarily drawn to scale. Some features may be exaggerated or minimized to show details of particular components. Therefore, specific structural and functional details disclosed herein are not to be interpreted as limiting, but merely as a representative basis for teaching one skilled in the art.

The words and phrases used herein should be understood and interpreted to have a meaning consistent with the understanding of those words and phrases by those skilled in the relevant art. No special definition of a term or phrase, i.e., a definition that is different from the ordinary or customary meaning as understood by those skilled in the art, is intended to be implied by consistent usage of the term or phrase herein. To the extent that a term or phrase is intended to have a special meaning, i.e., a meaning other than that understood by skilled artisans, such a special definition shall be expressively set forth in the specification in a definitional manner that directly and unequivocally provides the special definition for the term or phrase.

In the following, various aspects and embodiments of the present disclosure will be described in more detail with reference to the figures enclosed.

Figure 2A:
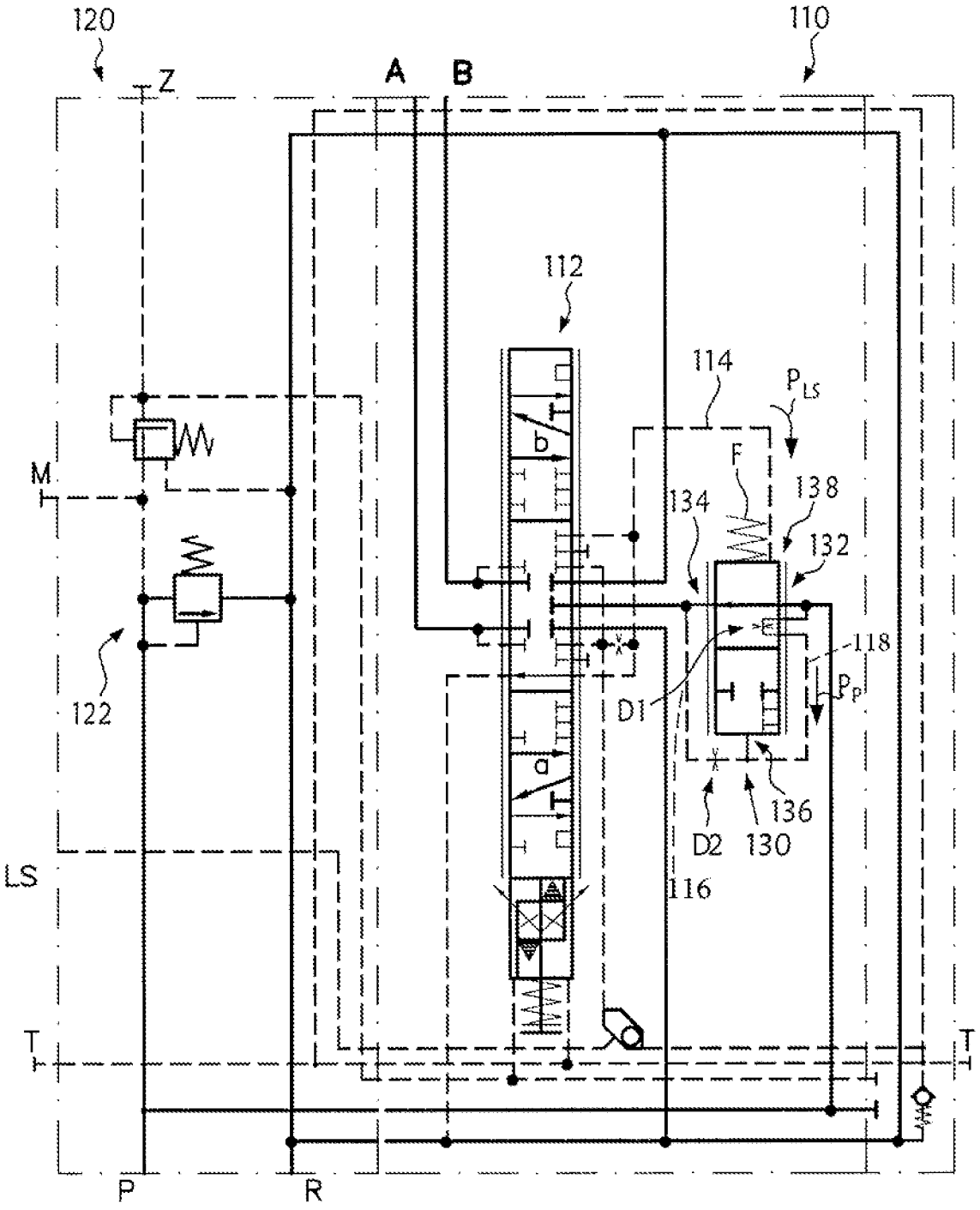
FIG. 2*a* shows a schematic representation of a valve assembly according to an embodiment of the present disclosure, including a flow control valve according to the present disclosure.

FIG. 2*a* shows schematically a valve assembly according to an illustrative embodiment of the disclosure. The valve assembly comprises a valve block 110 and a connection block 120 connected to the valve block 110. The connection block 120 comprises a pressure control pilot valve 122 and may be connected to a constant delivery pump system (not shown; cf. constant delivery pump system in FIG. 1*a*) or, alternatively, to a control pump system (not shown).

According to the embodiment shown in FIG. 2*a*, the valve block 110 may comprise a proportional directional spool valve 112 and a 2-way flow control valve 130 arranged in the supply line upstream of the proportional directional spool valve 112. The proportional directional spool valve 112 may be connected to e.g., two load connections A and B of the valve block 110, which may be connected to a consumer (not shown), such as a hydraulic cylinder.

The 2-way flow control valve 130 comprises a pre-load element F, e.g., a spring, an input-side supply connection 132, an output-side output connection 134, a first control connection 136 connected to a first tapping 116 of the 2-way flow control valve 130, said tapping being arranged on the output side of the 2-way flow control valve 130, and a second control connection 138 connected to an LS pressure duct 114. The first control connection 136 is connected to the first tapping 116 of the 2-way flow control valve 130, so that a pressure signal tapped by means of the first tapping acts via the first control connection 136 on the 2-way flow control valve 130 such that the pressure signal counteracts a pre-load generated by the pre-load element F. However, a pressure signal applied by the LS duct 114 to the 2-way flow control valve 130 via the second control connection 138 may support the pre-load generated by the pre-load element F.

In the illustrative embodiment shown in FIG. 2*a*, the 2-way flow control valve 130 may additionally comprise a second tapping 118 arranged on the input side and used for tapping a pressure signal in the supply line upstream of the 2-way flow control valve 130. In the valve condition shown in FIG. 2*a*, said pressure signal may be supplied to the first control connection 136 through a nozzle D1 or, alternatively, through an orifice. Herein, the nozzle D1 may be connected to the first tapping 116 and/or the first control connection 136 at least over a portion of the control stroke of the 2-way flow control valve.

According to the embodiment shown in FIG. 2*a*, the 2-way flow control valve 130 may therefore be pre-loaded in the opening direction by the pre-load element F and a pressure medium applied to the second control connection 138, whereas pressure signals, which are supplied to the first control connection 136 by means of the first and second tappings 116 and 118, respectively, may be effective in the closing direction. The first tapping 116 may be connected to the first control connection 136 via a second nozzle D2, irrespectively of the valve position of the 2-way flow control valve. If the 2-way flow control valve 130 is at the switching position shown in FIG. 2*a*, a pressure signal $p_p$ may be tapped at the input-side supply connection 132. Depending on the nozzles D1 and D2, the 2-way flow control valve 130 may now be manipulated by the pressure signal $p_p$ such that the pressure signal applied to the first control connection 136 may be determined by the pressure signal $p_p$, as will be described hereinafter in more detail with respect to FIG. 3*a*.

An "opening direction" may generally indicate a "control direction" of the 2-way flow control valve along which the 2-way flow control valve is open. In contrast thereto, a "closing direction" may indicate a control direction of the 2-way flow control valve along which the 2-way flow control valve is closed.

Assuming that cross-sectional areas of control piston 140 (shown in FIG. 2*d*) in the 2-way flow control valve 130 are equal at the first control connection 136 and the second control connection 138 (the cross-sectional areas will be designated by $A_K$ hereinafter), the following holds true for the 2-way flow control valve 130 at an equilibrium of forces: $(p_p-p_{LS})=F_F/A_K$, where the pressure $p_{LS}$ stands for a pressure signal signaled via the LS duct 114 and the pressure signal $p_p$ is established, depending on the parameters of the nozzles D1, D2, via the pressure signals signaled by the first and second tappings 116 and 118, respectively (the spring force is designated by $F_F$; normally, the spring force may be composed of a spring pre-load $F_{FV}$ and, at a given spring constant $c_{spring}$, of the force $F_{Hook}=c_{spring}*\Delta x$ resulting from a stroke $\Delta x$ of the spring: $F_F=F_{FV}+F_{Hook}$). If the load pressure downstream of the proportional directional spool valve 112 decreases, also the volumetric flow through the 2-way flow control valve 130 will decrease. This means that the pressure difference $(p_p-p_{LS})$ may decrease as well and the pressure $p_{LS}$ may therefore become slightly higher or the pressure $p_p$ may become slightly lower. The 2-way flow control valve 130 may thus represent a pressure-controlled pressure compensator valve, a corrupting pressure signal being applied by means of the second tapping at least over part of the stroke in the closing direction and/or to the first control connection 136.

Neither the above considerations (nor the corresponding part of the description relating to FIG. 3*a* hereinbelow) take into account a flow force $F_{flow}$ having a closing effect on the control piston and originating from the pressure difference occurring at the control piston and from the volumetric flow. It is noted that the flow force $F_{flow}$ may increase linearly up to a maximum value as the volumetric flow increases and, after having reached the maximum value, it may decrease hyperbolically so that the flow force $F_{flow}$ may possibly account for a substantial part of the equilibrium of forces and could then no longer be neglected without causing intolerable mistakes. With due regard to $F_{flow}$, it follows from the equilibrium of forces that: $(p_p-p_{LS})+f_{flow}/A_K=F_F/A_K$.

In the valve condition shown, the 2-way flow control valve would, without the second tapping 118 by means of which a corrupting pressure signal acts in the closing direction on the 2-way flow control valve 130 in addition to the pressure signal tapped from the first tapping, be controlled in the opening direction such that a higher volumetric flow would be allowed to pass and the pressure difference would be controlled to a constant value in the equilibrium of forces. Due to the corrupting pressure signal, which, however, acts in the closing direction on the 2-way flow control valve 130 through the second tapping 118, the control piston 140 is controlled in the closing direction, since the corrupting pressure signal, tapped by the second tapping, counteracts the LS pressure signal in the case of a decrease in pressure originating from a decreasing volumetric flow or a pressure increase in the load circuit, which is reported by the LS duct 114. Accordingly, the control piston 140 may be deflected along the closing direction and the volumetric flow may decrease in comparison with a case where no corrupting pressure signal occurs, i.e., it may not be con-trolled to a constant value.

Figure 1B:
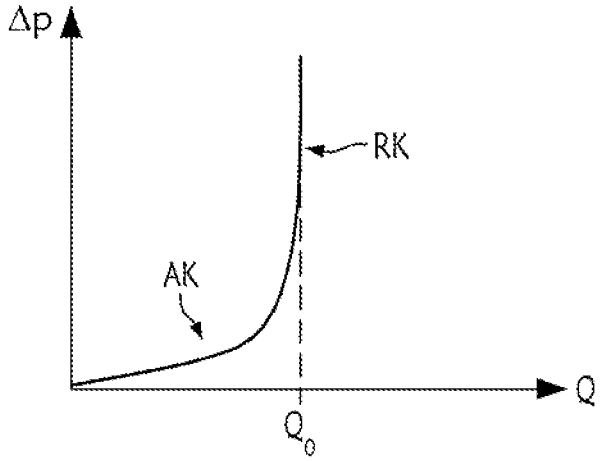
FIG. 1b Prior Art
FIG. 1*b* shows a schematic representation of the characteristic of a known directional control valve.
Figure 2B:
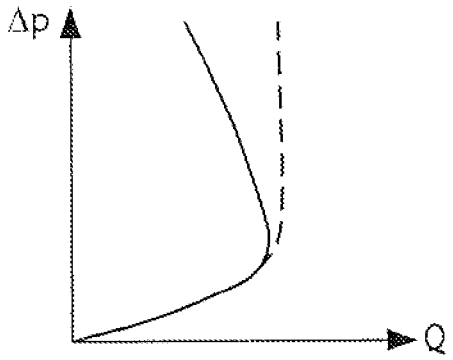
FIG. 2*b* shows a schematic representation of a characteristic of a flow control valve according to an embodiment of the present disclosure.

The resultant characteristic for the 2-way flow control valve 130 according to FIG. 2*a*, where the difference (pump pressure—$p_{LS}$) is plotted against the volumetric flow, is schematically shown in FIG. 2*b*, where the vertical characteristic curve of conventional 2-way flow control valves (cf. FIG. 1*b*) is indicated as a broken line. As can easily be seen, the characteristic of the 2-way flow control valve 130 according to the illustrative embodiment shown in FIG. 2*a* may be inclined to the left in comparison with the vertical profile of conventional characteristics.

Figure 2C:
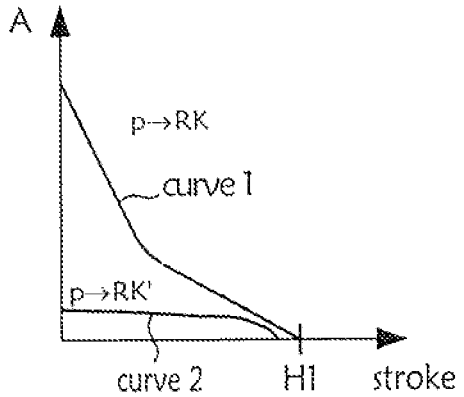
FIG. 2*c* shows a representation of a profile of a flow-through cross-sectional area of the flow control valve along a control stroke according to an embodiment of the present disclosure.
Figure 2D:
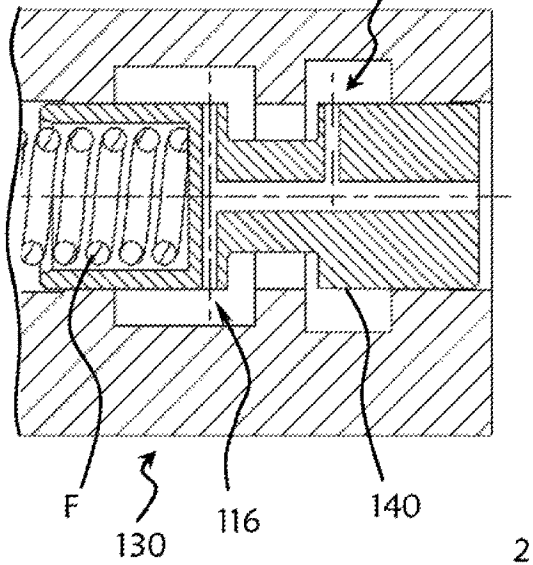
FIG. 2*d* is a schematic view of a portion of the flow control valve of FIG. 2*a* showing a piston of the flow control valve.

FIG. 2*c* shows a schematic representation of a profile of a flow-through cross-sectional area of the flow control valve along a control stroke according to an embodiment of the present disclosure. The schematic representation shows in particular the profile of the flow-through cross-sectional area at the control edge through the 2-way flow control valve 130 (cf. curve 1) and at the nozzle D1 (cf. curve 2) along a stroke H1 of the control piston. According to the embodiment shown, the profile of the flow-through cross-sectional area of the nozzle D1 may be constant over a portion of the stroke H1 and may then approach zero.

Figure 3B:
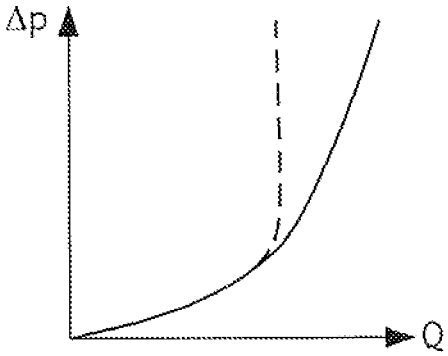
FIG. 3*b* shows a schematic representation of a characteristic of a flow control valve according to another embodiment of the present disclosure.
Figure 3C:
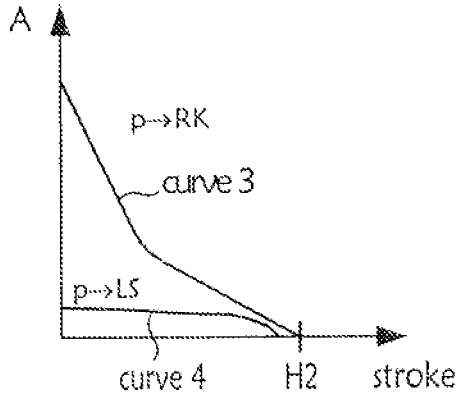
FIG. 3*c* shows a representation of a profile of a flow-through cross-sectional area of the flow control valve along a control stroke according to an embodiment of the present disclosure.
Figure 3D:
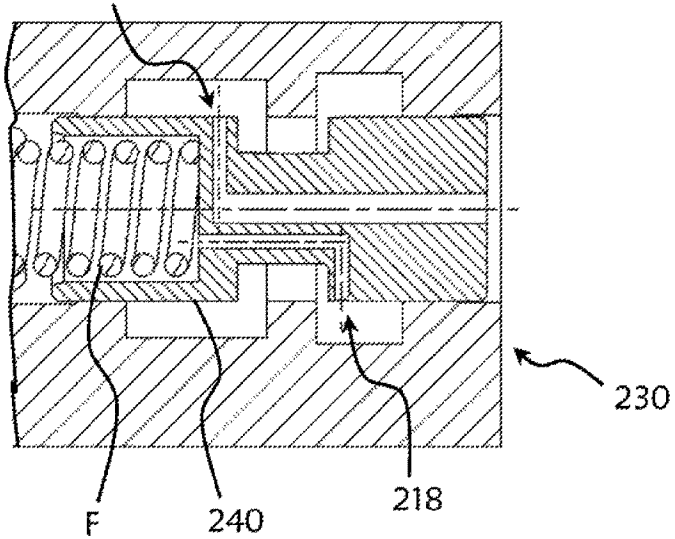
FIG. 3*d* is a schematic view of a portion of the flow control valve of FIG. 3*a* showing a piston of the flow control valve.
Figure 3A:
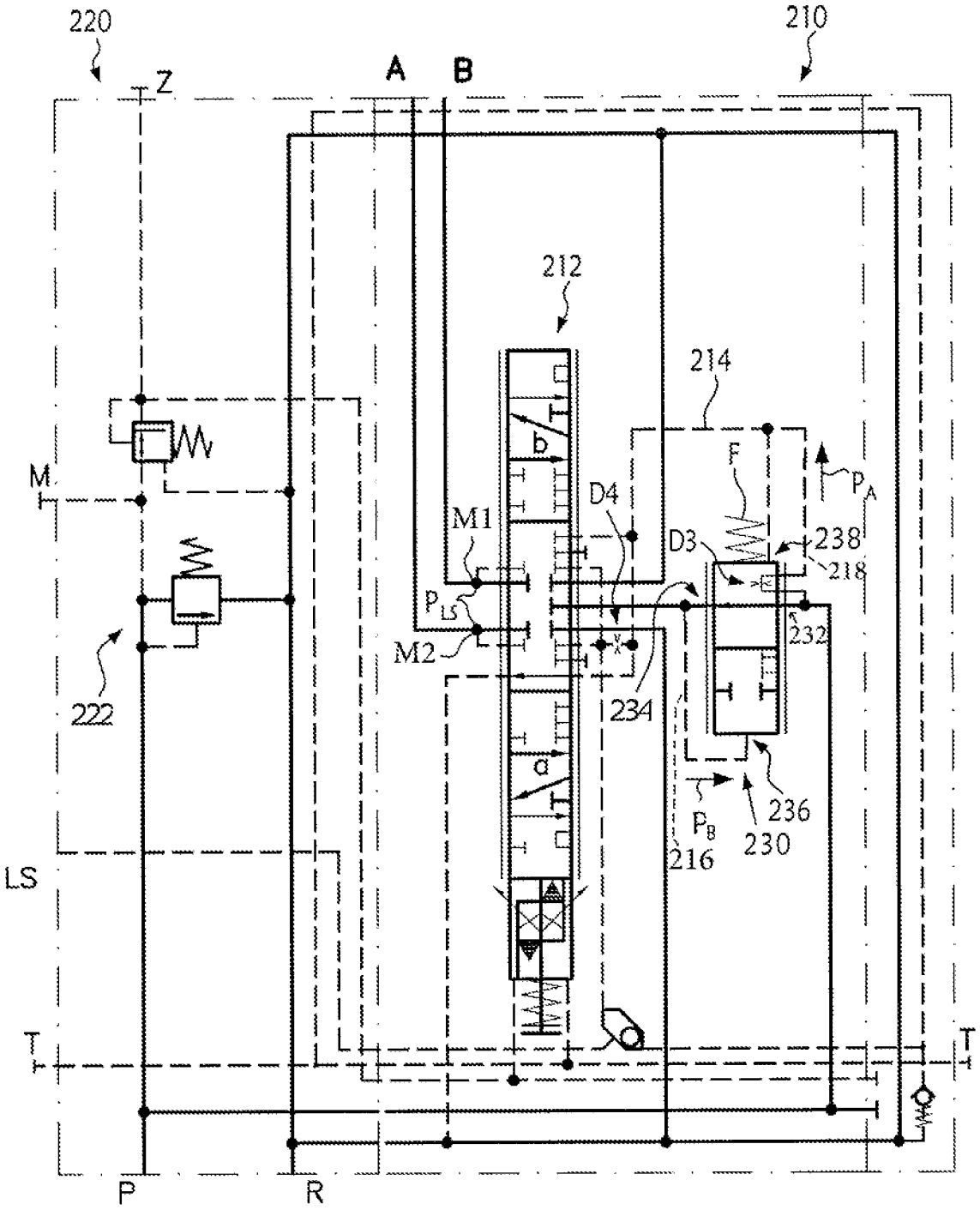
FIG. 3*a* shows a schematic representation of a valve assembly according to a further illustrative embodiment of the present disclosure, including a flow control valve according to the present disclosure.

FIG. 3*a* shows schematically a valve assembly according to another illustrative embodiment of the present disclosure. The valve assembly comprises a valve block 210 and a connection block 220 connected to the valve block 210. The connection block 220 comprises a pressure control pilot valve 222 and may be connected to a constant delivery pump system (not shown; cf. the constant delivery pump system in FIG. 1*a*) or, alternatively, to a control pump system (not shown).

According to the embodiment shown in FIG. 3*a*, the valve block 210 comprises a proportional directional spool valve 212 and a 2-way flow control valve 230 arranged in the supply line up-stream of the proportional directional spool valve 212. The proportional directional spool valve 212 may be connected to e.g., two load connections A and B of the valve block 210, which may be connected to a consumer (not shown), such as a hydraulic cylinder.

The 2-way flow control valve 230 comprises a pre-load element F, an input-side first supply connection 232, an output connection 234 arranged on the output side, a first control connection 236 connected to a first tapping 216 of the 2-way flow control valve 230, said tapping being arranged on the output side of the 2-way flow control valve 230, and a second control connection 238 connected to an LS pressure duct 214. The first control connection 236 may be connected to the first tapping 216 of the 2-way flow control valve 230 so that a pressure signal tapped by the first tapping 216 may act via the first control connection 236 on the 2-way flow control valve 230 such that the pressure signal signaled from the first tapping 216 may counteract a pre-load generated by the pre-load element F, e.g., a spring. However, a pressure signal applied by the LS duct 214 to the 2-way flow control valve 230 via the second pressure connection 238 may support the pre-load generated by the pre-load element F.

In the illustrative embodiment shown in FIG. 3*a*, the 2-way flow control valve 230 may additionally comprise a second tapping 218 arranged on the input side and used for tapping a pressure signal in the supply line upstream of the 2-way flow control valve 230. In the valve condition shown in FIG. 3*a*, said pressure signal may be supplied to the second control connection 238 through a nozzle D3 or, alternatively, through an orifice. Herein, the nozzle D3 may be connected to the first tapping and/or the second control connection 238 at least over a portion of the control stroke of the 2-way flow control valve.

According to the embodiment shown in FIG. 3*a*, the 2-way flow control valve 230 may therefore be pre-loaded in the opening direction by the pre-load element F and a pressure medium applied to the second control connection 238, whereas pressure signals signaled to the first control connection 236 from the first tapping 216 may be effective in the closing direction.

Similar to the embodiment shown in FIG. 2*a*, the following may hold true for the 2-way flow control valve 230: assuming that cross-sectional areas of control piston 240 (shown in FIG. 3*d*) in the 2-way flow control valve 230 are equal at the first control connection 236 and the second control connection 238 (the cross-sectional areas will be designated by $A_K$ hereinafter), the following may hold true for the equilibrium of forces: $(p_B-p_A)=F_F/A_K$, where the pressure $p_A$ stands for the pressure, which, in the case of an active manipulation of the 2-way flow control valve 230, may be effective between the nozzle D3 and a nozzle D4 connected in series therewith and which may be signaled from the second tapping to the second control connection 238 as a corrupting pressure signal. The pressure $p_B$ may represent the pressure signal reported from the first tapping ($F_F$ stands for the spring force, as has been explained above in connection with FIG. 2*a*). In addition, a load pressure signal $p_{LS}$ may be tapped at points M1 and M2, respectively, depending on the switching position of the proportional directional spool valve 212. If the manipulation of the 2-way flow control valve 230 may be active, $p_{LS}$ may be effective between the consumer connections and the nozzle D4, otherwise it may be effective up to the control connection 238 in the case of an inactive manipulation. As will be explained hereinbelow, the ratio between $p_{LS}$ and $p_A$ may be predetermined by the nozzles D3 and D4.

If the load pressure downstream of the proportional directional spool valve 212 decreases, there may be a decrease in the volumetric flow through the 2-way flow control valve 230. As the load pressure decreases, there may be a decrease in the pressure difference $(p_B-p_A)$, i.e., the pressure $p_A$ may become slightly higher or the pressure $p_B$ may become slightly lower. Due to the corrupting pressure signal $p_A$, which may be additionally effective in the opening direction, the equilibrium of forces may be shifted in the opening direction in comparison with the known pressure compensator valve shown in FIG. 1*a*, so that the 2-way flow control valve 230 may be opened wider and a higher volumetric flow may therefore pass through the 2-way flow control valve 230. Hence, the 2-way flow control valve 230 may represent a pressure-controlled pressure compensator valve, a corrupting pressure signal being applied by means of the second tapping 218 at least over part of the stroke in the opening direction and/or to the second control connection 238. In particular, the volumetric flow is not controlled to a constant value.

As regards an adjustment of the pressure signal $p_A$, said pressure signal may, according to illustrative embodiments, be adjusted by the nozzle D3 and the nozzle D4 connected in series therewith. In the case of series-connected nozzles or a chain of nozzles (the volumetric flow is constant when nozzles are connected in series), it may be normally, at least approximately, such that the following may hold true for a ratio of a pressure upstream of the first nozzle (here D3; the pressure upstream of the nozzle D3 is here designated by pD3) in a row or chain to a pressure between the first and second nozzles (here D4; the pressure upstream of the nozzle D4 is here designated by $p_{D4}$): $p_{D3}/p_{D4}=(d_{D4}/d_{D3})^4+1$, where $d_{D4}/d_{D3}$ stands for the diameter of the nozzle D3/D4. At this point, reference should be made to the fact that this applies analogously to the nozzles D1 and D2 in FIG. 2*a* above.

In the valve condition shown, the 2-way flow control valve would, without the second tapping 218 by means of which a corrupting pressure signal acts in the closing direction on the 2-way flow control valve 230 in addition to the pressure signal tapped from the first tapping 216, be controlled in the opening direction such that (in comparison with the embodiment shown in FIG. 3*a*) a smaller volumetric flow would be allowed to pass and the pressure difference would be controlled to a (by way of comparison) smaller constant value in the equilibrium of forces. Due to the corrupting pressure signal, which, however, may act in the opening direction on the 2-way flow control valve 230 through the second tapping 218, the control piston 240 may be controlled in the opening direction, since the corrupting pressure signal, tapped by the second tapping 218, may amplify the LS pressure signal in the case of a decrease in pressure originating from a decreasing volumetric flow or a pressure increase in the load circuit, which may be signaled via the LS duct 114. Accordingly, the control piston 240 may be deflected to a greater extent along the opening direction and the volumetric flow may still increase further in comparison with a case where no corrupting pressure signal occurs.

The resultant characteristic for the 2-way flow control valve 230 according to FIG. 3*a*, where the difference (pump pressure−$p_{LS}$) is plotted against the volumetric flow, is schematically shown in FIG. 3*b*, where the vertical characteristic curve of conventional 2-way flow control valves (cf. FIG. 1*b*) is indicated as a broken line. As can easily be seen, the characteristic of the 2-way flow control valve 230 according to the illustrative embodiment shown in FIG. 3*a* may be inclined to the right in comparison with the vertical profile of conventional characteristics.

FIG. 3*c* shows a schematic representation of a profile of a flow-through cross-sectional area of the flow control valve along a control stroke according to an embodiment of the present disclosure. In particular, the profile of the flow-through cross-sectional area at the control edge through the 2-way flow control valve 230 (cf. curve 3) and at the nozzle D3 (cf. curve 4) along a stroke H2 of the control piston is schematically shown. According to the embodiment shown, the flow-through cross-sectional area of the nozzle D3 may be constant over a portion of the stroke H2 and may then approach zero.

The exemplary embodiments described with respect to FIGS. 3*a* to 3*c* allow to realize e.g., a transition from a condition of undersupply of the 2-way flow control valve 230 to a condition of sufficient supply of the 2-way flow control valve 230 without a sudden hydraulic shock, since, due to the corrupting pressure signal, a pressure difference occurring at the 2-way flow control valve 230 may be proportionally adapted to a volumetric flow flowing through the valve. In valves having a vertical characteristic curve, however, a sudden hydraulic shock occurs at the transition.

Figure 4B:
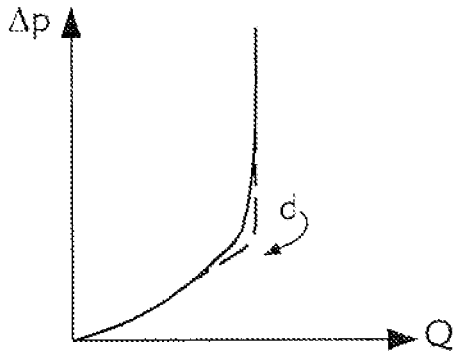
FIG. 4*b* shows a schematic representation of a characteristic of a flow control valve and a profile of a flow-through cross-sectional area of the flow control valve along a control stroke according to another embodiment of the present disclosure.
Figure 4C:
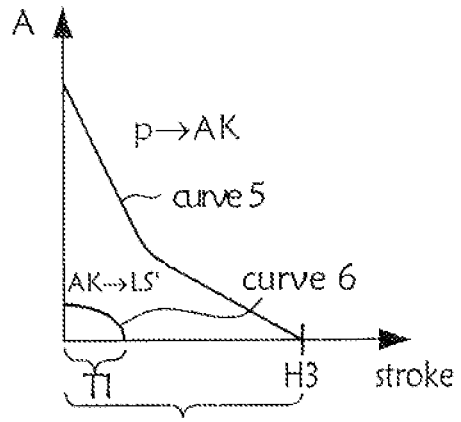
FIG. 4*c* shows a profile of a flow-through cross-sectional area of the flow control valve along a control stroke according to an embodiment of the present disclosure.
Figure 4D:
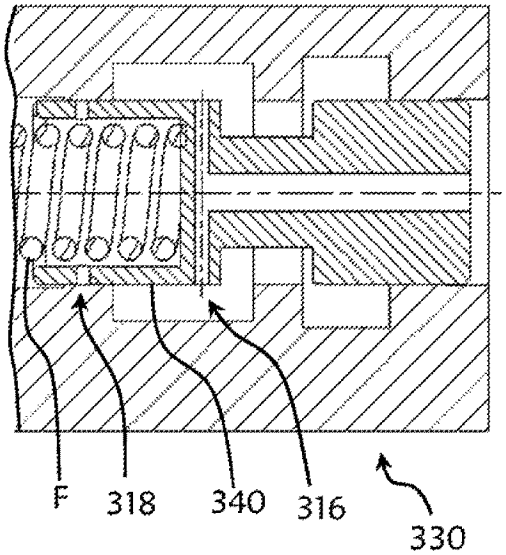
FIG. 4*d* is a schematic view of a portion of the flow control valve of FIG. 4*a* showing a piston of the flow control valve.
Figure 4A:
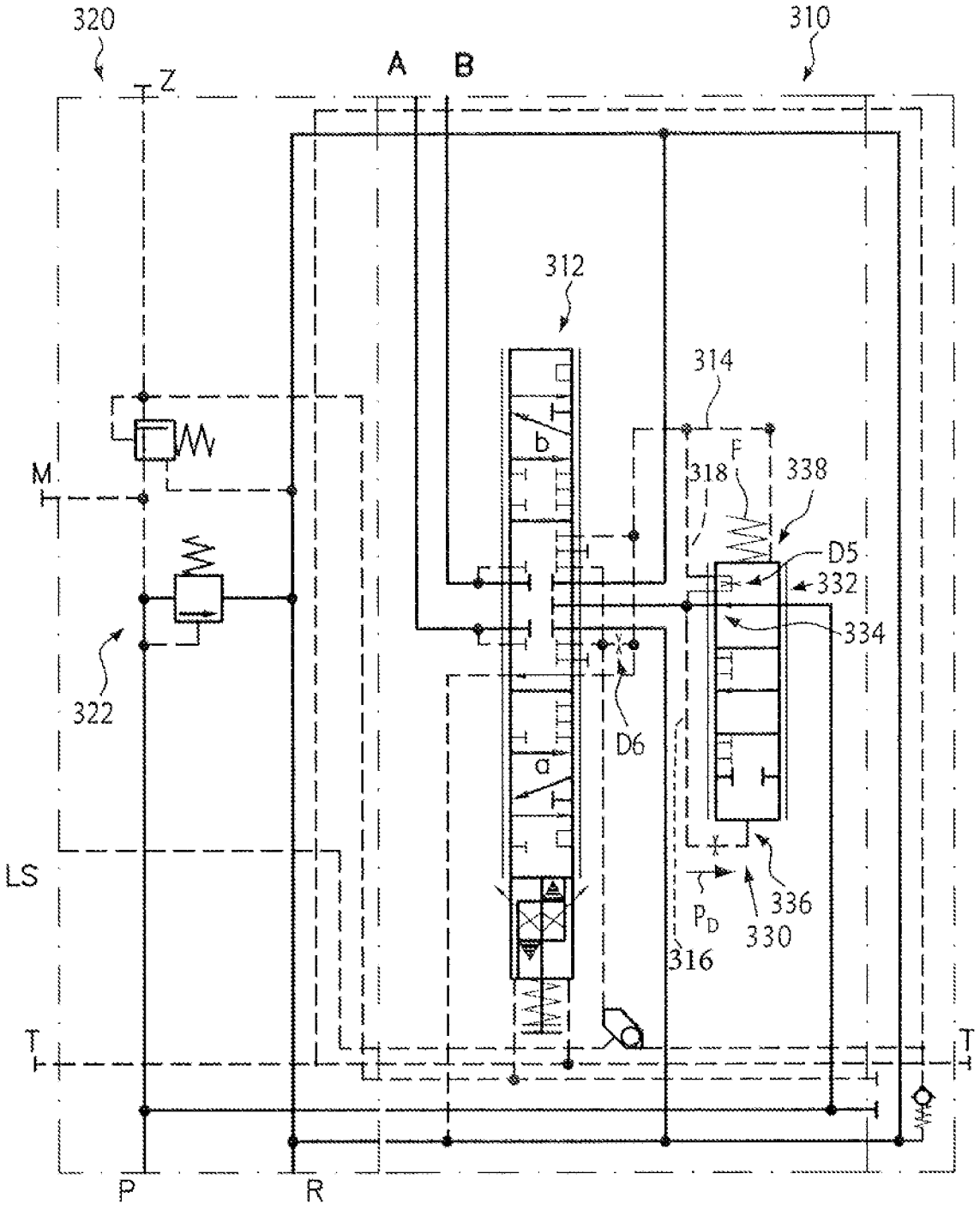
FIG. 4*a* shows a schematic representation of a valve assembly according to another illustrative embodiment of the present disclosure, including a flow control valve according to the present disclosure.

FIG. 4*a* shows a valve assembly according to additional illustrative embodiments of the present disclosure. In this figure, a valve assembly is schematically shown, which assembly comprises a valve block 310 and a connection block 320 connected to the valve block 310. The connection block 320 comprises a pressure control pilot valve 322 and may be connected to a constant delivery pump system (not shown; cf. the constant delivery pump system in FIG. 1*a*) or, alternatively, to a control pump system (not shown). The valve block 310 may additionally comprise a proportional directional spool valve 312 and a ⅔-way flow control valve 330 arranged in the supply line upstream of the proportional directional spool valve 312. The proportional directional spool valve 312 may be connected to e.g., two load connections A and B of the valve block 310, which are connected to a consumer (not shown), such as a hydraulic cylinder.

According to the embodiment shown in FIG. 4*a*, the ⅔-way flow control valve 330 comprises a pre-load element F, an input-side first supply connection 332, an output connection 334 arranged on the output side, a first control connection 336 connected to a first tapping 316 of the ⅔-way flow control valve 330, said tapping 316 being arranged on the output side of the ⅔-way flow control valve 330, and a second control connection 338 connected to an LS pressure duct 314. The first control connection 336 may be connected to the first tapping 316 of the ⅔-way flow control valve 330, so that a pressure signal tapped by the first tapping 316 acts via the first control connection 336 on the ⅔-way flow control valve 330 such that the pressure signal signaled from the first tapping 316 may counteract a pre-load generated by a pre-load element F, e.g., a spring. However, a pressure signal applied by the LS duct 314 to the ⅔-way flow control valve 330 via the second pressure connection 338 may support the pre-load generated by the pre-load element F.

The ⅔-way flow control valve 330 shown in FIG. 4*a* may additionally comprise a second tapping 318 arranged on the output side, so that a corrupting pressure signal tapped on the output side may be supplied to the second control connection 338 via a nozzle D5. According to alternative embodiments of the valve assembly shown in FIG. 4*a*, the second tapping may be provided on the input side so as to supply to the second control connection 338 a corrupting pressure signal, which has been tapped on the input side, via the nozzle D5. The pressure reported via the nozzle D5 may be adjusted e.g., via a chain of nozzles with a nozzle D6, as has been described above. Through the second tapping 318, the second control connection 338 may have supplied thereto, in addition to the LS pressure signal signaled at the second control connection 338, a corrupting pressure signal that may be applied to the ⅔-way flow control valve by means of the second tapping 318 for supporting the pre-load in the opening direction. This may apply to a valve condition a shown in FIG. 4*a*.

In a valve condition b corresponding to a deflection of the ⅔-way flow control valve 330 from the valve condition a in the closing direction, a connection between the second tapping 318 and the second control connection 338 may be separated, while a feed-through (or an aperture cross-section, not shown) between the input side and the output side of the ⅔-way flow control valve may be maintained.

In a valve condition c corresponding to a further deflection of the ⅔-way flow control valve 330 from the valve condition b in the closing direction, the valve may be closed in the feed-through direction as well as in a connection between the second tapping 318 and the second control connection 338. According to a few illustrative examples, the ⅔-way flow control valve may be deflected fully in the closing direction in said valve condition c.

According to the embodiment shown, the corrupting pressure signal tapped at the second tapping 318 may be signaled at the second control connection 338 only over a portion of the control stroke in the opening direction. Hence, a manipulation of the ⅔-way flow control valve 330 may only take place over a portion of the control stroke. Thus, it may be possible to accomplish a better utilization of the corner power in the range of small pressure differences and small volumetric flows, and the ⅔-way flow control valve 330 shown in FIG. 4*a* may achieve a comparatively smaller pressure difference at the same volumetric flow in comparison with conventional 2-way flow control valves. In addition, volumetric flow control in the range of small pressure differences may be carried out more precisely.

FIG. 4*b* shows a schematic representation of a characteristic of the ⅔-way flow control valve 330 shown in FIG. 4*a*, a characteristic curve of conventional 2-way flow control valves (cf. e.g., 130 in FIG. 1*a*) being, by way of comparison, indicated by a broken line. It can be seen from FIG. 4*b* that in the ⅔-way flow control valve 330 according to the representation in FIG. 4*a* the control curve section (cf. RK in FIG. 1*b*) may be entered more quickly. In particular, in comparison with conventional 2-way flow control valves, the ⅔-way flow control valve 330 according to the embodiment shown in FIG. 4*a* may already be in the regulating range in the case of smaller pressure differences, as can be seen from mark d in FIG. 4*b*.

FIG. 4*c* shows schematically a profile of the flow-through cross-sectional area between control edges in the ⅔-way flow control valve according to FIG. 4*a* along a control stroke H3 of the ⅔-way flow control valve 330 (cf. FIG. 4*a*). It is noted that the curve profile identified as curve 5 in FIG. 4*c* shows the flow-through cross-sectional area between the input-side and output-side connections, whereas the curve profile identified as curve 6 shows the profile of the flow-through cross-sectional area of nozzle D5 along the control piston stroke H3. It is noted that the nozzle D5 may be only open over a portion of the control stroke, in particular along a subsection T1 that may be smaller than a subsection T2, along which the ⅔-way flow control valve 330 (cf. FIG. 4*a*) may be open in the flow-through direction. According to exemplary embodiments, the following may hold true: $T1<T2\leq H3$.

In the above embodiments described with reference to the figures, a proportional directional spool valve and a consumer are provided. This does not represent a limitation of the present disclosure. Instead of one consumer and one proportional directional spool valve, two proportional directional spool valves and two consumers or even more than two proportional directional spool valves and more than two consumers may be provided analogously to the representation according to FIG. 1*a*, and a pressure compensator valve with a manipulated characteristic may be provided upstream of at least one proportional directional spool valve.

The particular embodiments disclosed above are illustrative only, as the disclosure may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the disclosure. Additionally, the features of various implementing embodiments may be combined to form further embodiments of the invention. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

What is claimed is:

1. A valve assembly for a hydraulic application, the valve assembly comprising:

a proportional directional spool valve for controlling a hydraulic consumer; and a pressure-controlled 2-way flow control valve comprising:

a first output-side tapping for applying a first pressure signal in a closing direction of the 2-way flow control valve;

a control connection for receiving a second pressure signal in an opening direction of the 2-way flow control valve from an LS pressure signaling duct; and a second tapping for applying a pressure signal for corrupting the first pressure signal or the second pressure signal in the closing direction or the opening direction which is effective at least over a portion of a control stroke of the 2-way flow control valve;

wherein the 2-way flow control valve is connected to the proportional directional spool valve on an output side of the 2-way flow control valve or on an input side of the 2-way flow control valve.

2. The valve assembly according to claim 1 wherein the 2-way flow control valve is configured such that the corrupting pressure signal is able to be applied only over a part of the control stroke of the 2-way flow control valve.

3. The valve assembly according to claim 1 further comprising one of a first nozzle and a first orifice via which the corrupting pressure signal may be applied to the 2-way flow control valve in the closing direction or the opening direction in a part of the control stroke tapping the corrupting pressure signal.

4. The valve assembly according to claim 3 further comprising one of a second nozzle and a second orifice connected in series with the one of the first nozzle and the first orifice, the corrupting pressure signal being applicable to the 2-way flow control valve via a control connection arranged between 1) the one of the second nozzle and the second orifice and 2) the one of the first nozzle and the first orifice.

5. The valve assembly according to claim 1 wherein the second tapping is arranged on the input side of the 2-way flow control valve.

6. The valve assembly according to claim 5 wherein the corrupting pressure signal is appliable in the opening direction, so that, when the difference between the first pressure signal and the second pressure signal increases, an increasing volumetric flow is established on the output side of the 2-way flow control valve.

7. The valve assembly according to claim 1 wherein the second tapping is arranged on the output side of the 2-way flow control valve and the corrupting pressure signal is appliable in the opening direction.

8. The valve assembly according to claim 7 wherein the control stroke comprises a flow-through section and a shut-off section, in which no volumetric flow is able to occur on the output side of the 2-way flow control valve, the corrupting pressure signal being, in the flow-through section, appliable to the 2-way flow control valve over a portion of the control stroke.

9. The valve assembly according to claim 5 wherein the corrupting pressure signal is appliable in the closing direction, so that, when the difference between the first pressure signal and the second pressure signal increases, a decreasing volumetric flow is established on the output side of the 2-way flow control valve.

10. The valve assembly according to claim 1 wherein the 2-way flow control valve is configured such that the corrupting pressure signal is blockable over a portion of the control stroke.

11. The valve assembly according to claim 1 wherein the 2-way flow control valve is connected to the proportional directional spool valve on the output side of the 2-way flow control valve.

12. The valve assembly according to claim 11 further comprising a valve block in which the proportional directional spool valve is integrated together with the 2-way flow control valve.

13. The valve assembly according to claim 1 wherein the 2-way flow control valve is connected to the proportional directional spool valve on the input side of the 2-way flow control valve.

14. The valve assembly according to claim 13 further comprising a valve block in which the proportional directional spool valve is integrated together with the 2-way flow control valve.

15. A valve arrangement for hydraulic applications, the arrangement comprising:

a pressure-controlled 2-way flow control valve;

a first output-side tapping for applying a first pressure signal in a closing direction of the 2-way flow control valve;

an LS pressure signaling duct for applying a second pressure signal in an opening direction of the 2-way flow control valve;

a second tapping for applying a pressure signal for corrupting the first pressure signal or the second pressure signal in the closing direction or the opening direction which is effective at least over a portion of a control stroke of the 2-way flow control valve; and a proportional directional spool valve for controlling a hydraulic consumer;

wherein the 2-way flow control valve is connected to the proportional directional spool valve on an output side of the 2-way flow control valve or on an input side of the 2-way flow control valve.

16. The valve arrangement according to claim 15 wherein the 2-way flow control valve is connected to the proportional directional spool valve on the output side of the 2-way flow control valve.

17. The valve arrangement according to claim 16 further comprising a valve block in which the proportional directional spool valve is integrated together with the 2-way flow control valve.

18. The valve arrangement according to claim 15 wherein the 2-way flow control valve is connected to the proportional directional spool valve on the input side of the 2-way flow control valve.

19. The valve arrangement according to claim 18 further comprising a valve block in which the proportional directional spool valve is integrated together with the 2-way flow control valve.

20. A pressure-controlled 2-way flow control valve for hydraulic applications, the pressure-controlled 2-way flow control valve comprising:

a first output-side tapping for applying a first pressure signal in a closing direction of the 2-way flow control valve;

a control connection for receiving a second pressure signal in an opening direction of the 2-way flow control valve from an LS pressure signaling duct; and a second tapping for applying a pressure signal for corrupting the first pressure signal or the second pressure signal in the closing direction or the opening direction which is effective at least over a portion of a control stroke of the 2-way flow control valve;

wherein the 2-way flow control valve is configured so that the corrupting pressure signal is blockable over a portion of the control stroke, and wherein the first and second tappings are arranged on opposite sides of a body of the 2-way flow control valve.

* * * * *